US006177386B1

(12) United States Patent
Aurin

(10) Patent No.: US 6,177,386 B1
(45) Date of Patent: Jan. 23, 2001

(54) LUBRICANT AND USE THEREOF

(75) Inventor: Norbert Aurin, Ockenheim (DE)

(73) Assignee: Chemische Fabrik Budenheim Rudolf A. Oetker, Budenheim (DE)

( * ) Notice: Under 35 U.S.C. 154(b), the term of this patent shall be extended for 0 days.

(21) Appl. No.: 09/202,881

(22) PCT Filed: Jun. 11, 1997

(86) PCT No.: PCT/DE97/01217

§ 371 Date: Sep. 9, 1999

§ 102(e) Date: Sep. 9, 1999

(87) PCT Pub. No.: WO98/00483

PCT Pub. Date: Jan. 8, 1998

(30) Foreign Application Priority Data

Jul. 2, 1996 (DE) ..... 196 26 529
Sep. 14, 1996 (DE) ..... 196 37 539

(51) Int. Cl.[7] ..... C10M 113/02

(52) U.S. Cl. ..... 508/125; 508/126; 508/127; 508/129

(58) Field of Search ..... 508/125, 126, 508/127, 129

(56) References Cited

U.S. PATENT DOCUMENTS 3,637,498 * 1/1972 Sawyer ..... 508/125
4,039,337 * 8/1977 Brown et al. ..... 508/127
4,052,323 * 10/1977 Feneberger et al. ..... 508/129
4,710,307 12/1987 Periard et al. ..... 252/18
5,089,154 * 2/1992 King ..... 508/126
5,294,355 * 3/1994 King et al. ..... 508/127
5,445,748 * 8/1995 Holinski ..... 508/129
5,492,639 * 2/1996 Schneider et al. ..... 508/126
5,691,282 * 11/1997 Periard et al. ..... 508/126

FOREIGN PATENT DOCUMENTS 1 444 795 6/1971 (DE) .
0 164 637 12/1985 (EP) .
1 359 430 7/1974 (GB) .

* cited by examiner

*Primary Examiner*—Jacqueline V. Howard
(74) *Attorney, Agent, or Firm*—Michael L. Dunn

(57) ABSTRACT

The invention relates to a lubricant which can be used as a mandrel lubricant with a content of 75 to 90 wt. % of graphite and contains 1 to 10 wt. % of a phosphate. Said lubricant can also contain 1 to 4 wt % alkali silicate, 1 to 10 wt. % bentonite, 0.5 to 1 wt. % silico-phosphate and common solid lubricants. Said lubricant is preferably used as an aqueous suspension with a solid content of 20 to 40 wt. %.

25 Claims, No Drawings

LUBRICANT AND USE THEREOF

Lubricants which are used in the hot forming of metals have long been known. Such lubricants are composed, for example, of mixtures of graphite and mineral oil. Such mixtures decompose at normal temperatures of use of from 1100 to 1300° C. and thus produce a serious impact on the environment.

Lubricants which are used for lubricating the so-called mandrel rods during manufacturing of seamless pipes, have to satisfy particular criteria and are therefore composed of graphite and mixtures of substances which produce these particular properties. DE-B-2 350 716 describes a high-temperature lubricant of 10 to 90% graphite, 2 to 60% alkene polymer or copolymer, 0.2 to 8% suspension agent and 2 to 40% film stabiliser. EP-A-0 554 822 describes a lubricant which contains, in addition to graphite, one or more clay minerals of the bentonite class, as well as polysaccharide and a non-ionic tenside.

By and large, in addition to graphite, the lubricants known up until now contain organic, and thus decomposing, substances and/or additions, which seriously pollute the waste water occurring later, for example by sediment formation, and thus represent serious damage to the environment.

The object of the invention is thus to obtain a lubricant which can be used in particular as a mandrel lubricant, which, in addition to graphite, essentially contains where possible no organic substances carbonising at low temperatures at all, and is as little environmentally harmful with respect to waste water pollution as possible.

In accordance with the invention, this object is solved with a lubricant with a content of 75 to 90% by weight graphite, which is characterised in that it contains 1 to 10% by weight phosphates.

The advantage of the lubricants according to the invention compared to those of the prior art, in particular compared to mandrel lubricants, is in that they need not contain any organic substances, and preferably contain absolutely no organic substances, so the graphite is the only decomposing component. They thus preferably contain exclusively inorganic substances. Graphite, which is suitable for the main lubricating effect of such lubricants, is composed of pure carbon which, at the high temperatures of use, burns in an oxygen containing environment, wherein carbon dioxide is produced which creates a gas buffer on which the separation of the pipe and mandrel rod is principally based.

The other contents of the lubricant have the object of creating an even lubricant film, producing rapid drying of the lubricant film, and preventing damage to the mandrel rod and respectively to the internal surface of the pipe. These objects are primarily solved in accordance with the invention by means of the phosphates which, at the high temperatures of use, form a low-viscosity, reactive molten mass which is able to dissolve scale and similar pollutants and thereby prevent the harmful effects thereof.

The lubricants according to the invention preferably contain 85 to 90% by weight graphite and advantageously 3 to 5% by weight phosphates.

It is particularly advantageous to use a phosphate mixture of tetrasodium diphosphate, primary zinc orthophosphate, primary manganese orthophosphate, disodium dihydrogen diphosphate and potassium polyphosphate as phosphates in the lubricant according to the invention. This phosphate mixture advantageously contains 25 to 50, preferably 33 to 43% by weight tetrasodium diphosphate, 1 to 20, preferably 3 to 11% by weight primary zinc orthophosphate, 0.5 to 20, preferably 1 to 10% by weight primary manganese orthophosphate, 2 to 25, preferably 5 to 15% by weight disodium dihydrogen diphosphate and 8 to 35, preferably 15 to 25% by weight potassium polyphosphate. A phosphate mixture well suited for this purpose contains approximately 38% by weight tetrasodium diphosphate, approximately 7% by weight primary zinc orthophosphate, approximately 5% by weight primary manganese orthophosphate, approximately 10% by weight disodium dihydrogen diphosphate and approximately 20% by weight potassium polyphosphate.

Advantageously, the phosphate mixture added as the phosphates to the lubricant additionally contains 5 to 25, preferably 10 to 20% by weight boric acid and/or 0.5 to 15, preferably 1 to 10% by weight hydroxyl apatite. The well suited phosphate mixture described hereinabove advantageously contains approximately 15% by weight boric acid and approximately 5% by weight hydroxyl apatite.

In addition to the 1 to 10% by weight phosphates, in particular the preferred phosphate mixture described hereinabove, and the 95 to 90% by weight graphite, the lubricant according to the invention advantageously also contains 1 to 4, preferably 2 to 2.5% by weight alkali silicate, in particular sodium disilicate, and/or 1 to 10, preferably 4 to 6% bentonite, preferably commercially available bentonite 34 with a 6 $m^2/g$ BET surface area, and/or 0.5 to 1, preferably 0.7 to 0.9% by weight silico-phosphate, which intensify the action of the phosphate mixture described hereinabove. The latterly described percentages relate to the total weight of solids of the lubricant according to the invention, while the percentages of the phosphate mixture including those of the boric acid and the hydroxyl apatite relate only to the total weight of the solids of the phosphate mixture alone.

Any graphite, natural or synthetic graphite normally used for lubricants, advantageously one with a high crystallinity and an ash content of less than 5%, can be used as the graphite. A sodium silicate with a $SiO_2$:$Na_2O$ ratio of 2 is advantageously used as the sodium silicate. The silico-phosphate used advantageously contains approximately 22% $SiO_2$and approximately 54% $P_2O_5$.

The mandrel lubricants according to the invention are preferably used as aqueous suspensions with a solids content of 20 to 40% by weight, preferably 25 to 35% by weight. The application of the lubricant takes place in the normal manner, by spraying the suspension onto the mandrel rod after it has left the cooling bath, and is again transported to the rolling process Advantageously, the lubricants according to the invention can additionally contain normal solid lubricants such, as calcium fluoride, cryolite, antimony trioxide, molybdenum sulphide, zinc pyrophosphate, boron nitride or iron (III) pyrophosphate.

The unexpected effectiveness of the lubricant additives and respectively the lubricants according to the invention were tested in a large number of experiments and trials. By applying a lubricant according to the invention onto the mandrel, sticking no longer occurred, and up to 50 units could be rolled by one mandrel. In contrast to this, there was frequent wastage when, previously, high-alloy steel was perforated by cross-rolling using a mandrel, as it was often impossible to remove the mandrel seized in the pipe. Even when it was possible, the wear on the mandrel was so great that on average only 3.8 units could be rolled with one mandrel.

Even with the so-called reciprocating rolling of austenitic pipes from pre-bored units, considerable advantages are produced with the lubricant according to the invention. The technical process is that a long, initially cold mandrel of a uniform thickness is inserted into a previously perforated, red-hot loop. Said mandrel is now conducted, together with the loop, in a reciprocating motion, that is to say alternately forward and backwards again, through the pilger rolling mill. Here, with the aid of eccentrically-shaped rollers, a kind of rolling and forging process is carried out, which step by step forms a seamless pipe from the loop, which pipe is then rolled over the whole length of the pilger mandrel. Pipes of a considerable length are produced in this way. The mandrel, which in the meantime has also become red-hot must then be withdrawn from said pipe. According to the prior art, this was often not possible at all, so the completed pipe had to be welded down from the mandrel and therefore destroyed. When the separation was at all successful, the separation pressure required was very high, on average 200 atmospheres overpressure. When the mandrel is lubricated with the lubricants according to the invention, which are applied as a viscous solution, the separation pressure required decreases to on average 20, maximum 60, atmospheres overpressure. Sticking of the mandrel thus no longer occurs.

Very good results are also achieved in the manufacturing of seamless pipes on the push bench. Here, the heated loop is pushed by means of a push rod through a system of constantly narrowing rings and respectively non-driven roll passes, whereby the loop is reduced and stretched. With this, the material flowing towards the rear should slide over the push rod without much friction where possible. It was shown that lubrication of the push rod with the lubricants according to the invention produces very good results, and that in particular the fusion and scoring occurring with oil-graphite lubrication ceases.

With hot extrusion too, for example of flywheels, the application of very thin coats of the lubricant according to the invention has proved very advantageous. While with oil-graphite lubrication, the extrusion die, composed of alloyed material, is often quickly destroyed by fissuring so it must often be replaced, the durability of the die is doubled by the lubricant according to the invention. Only energetic cleaning is still necessary, and not complete renewal of the extrusion die.

The technical advantages of use of the lubricant according to the invention are as follows:

- no environmental impact by decomposition products of organic contents,
- no sediment formation when the used mandrel rods are cooled and rinsed, as is the case, for example, with clay-containing lubricants,
- no damage to the mandrel rods and respectively to the internal pipe surfaces by grinding and score-forming scale particles and the like.

EXAMPLE 1

A lubricant according to the invention was produced in the form of a 30% aqueous slurry, the solids content of which had the following composition:

- 85 parts by weight natural graphite with 95% purity in the form of carbon
- 3 parts by weight bentonite
- 2.5 parts by weight sodium silicate with a $SiO_2$:$Na_2O$ ratio of 2.0
- 0.8 parts by weight of a silico-phosphate
- 8.7 parts by weight of a phosphate mixture of
  - 40 parts by weight tetrasodium diphosphate
  - 5 parts by weight primary zinc orthophosphate
  - 5 parts by weight manganese orthophosphate
  - 10 parts by weight disodium dihydrogen phosphate
  - 20 parts by weight potassium polyphosphate
  - 5 parts by weight boric acid
  - 5 parts by weight hydroxyl apatite The mandrel rods rotating on an MPM production line for manufacturing seamless steel pipes were sprayed with the above lubricant according to the invention. After evaporation of the water content, the weight of the coating of the dried lubricant film was 60g/$m^2$ of the mandrel rod surface.

When there was contact with the hot steel during the rolling process, no low-temperature carbonisation gases were produced. A suction device was not necessary.

In contrast to this, with use of a lubricant according to the prior art, 150 mg of low-temperature carbonisation gas per cubic meter had to be removed.

EXAMPLE 2

A lubricant according to the invention was produced in the form of a 15% by weight aqueous slurry, the solids content of which was composed of the following components:

- 73 parts by weight of a synthetic graphite with a purity of over 98% carbon
- 3.5 parts by weight bentonite
- 3.0 parts by weight sodium silicate with a $SiO_2$:$Na_2O$ ratio of 2.2
- 0.5 parts by weight of a silico-phosphate with 22% by weight $SiO_2$ and 54% by weight $P_2O_5$
- 20 parts by weight of a phosphate mixture of
  - 35 parts by weight tetrasodium pyrophosphate
  - 10 parts by weight primary zinc phosphate
  - 5 parts by weight manganese orthophosphate
  - 5 parts by weight disodium dihydrogen phosphate
  - 15 parts by weight potassium polyphosphate
  - 20 parts by weight boric acid
  - 10 parts by weight hydroxyl apatite On a pilger production line for manufacturing seamless pipes, the pilger mandrels were sprayed with an aqueous suspension of the above lubricant according to the invention. The weight of coating on the mandrel rod was 20 g/$m^3$, prior to the forming process.

After the pilgering process, the mandrel rod was smooth and free of scale particles. The internal surface of the pipes was also smooth. The internal roughness of the pipes had reduced significantly. It had an average value of 10 $\mu$m.

In contrast, when a known lubricant was used, the surface of the mandrel rod was covered with scale particles. These particles had to be abraded by hand after twelve forming procedures, which represents a considerable delay in production and is considered uneconomical. The average value of the internal roughness of the pipe was 53 $\mu$m.

What is claimed is:

1. A lubricant including from about 75 to 90% by weight of solids of graphite, 1 to 10% by weight of solids of phosphates, 1 to 10% weight of bentonite and 0.5 to 1% by weight silicophosphates, wherein the content of phosphates is calculated on the basis of $P_2O_5$, and the composition is essentially free of organic substances. carbonizable at temperatures below 110 degrees C.

2. Lubricant according to claim 1, comprising 3 to 5% by weight of solids of phosphates.

3. Lubricant according to claim 1 further comprising from 1 to 4% by weight of solids of alkali silicate.

4. Lubricant according to claim 2 further comprising from 1 to 4% by weight of solids of alkali silicate.

5. Lubricant according to claim 1 further comprising 2 to 2.5% by weight of solids of alkali silicate.

6. Lubricant according to claim 3 further comprising sodium silicate with a $SiO_2$:$Na_2O$ ratio of about 2 as the alkali silicate.

7. Lubricant according to claim 1 wherein the bentonite has a BET surface area of 6 $m^2/g$.

8. Lubricant according to claim 1 comprising a silico phosphate with about 22% $SiO_2$ and about 54% $P_2O_5$.

9. Lubricant according to claim 1 further comprising a natural or synthetic graphite with high crystallinity and an ash content below 5% by weight of solids.

10. Lubricant according to claim 3 further comprising a natural or synthetic graphite with high crystallinity and an ash content below 5% by weight of solids.

11. Lubricant according to claim 1 comprising a phosphate mixture of tetrasodium diphosphate, primary zinc orthophosphate, primary manganese orthophosphate, disodium dihydrogen diphosphate and potassium polyphosphate as the phosphates.

12. Lubricant according to claim 3 comprising a phosphate mixture of tetrasodium diphosphate, primary zinc orthophosphate, primary manganese orthophosphate, disodium dihydrogen diphosphate and potassium polyphosphate as the phosphates.

13. Lubricant according to claim 11 comprising a phosphate mixture which contains 25 to 50% by weight of solids of tetrasodium diphosphate, 1 to 20% by weight of solids of primary zinc orthophosphate, 0.5 to 20% by weight of solids of primary manganese orthophosphate, 2 to 25% by weight of solids of disodium dihydrogen diphosphate and 8 to 35% by weight of solids of potassium polyphosphate.

14. Lubricant according to claim 11 comprising 33 to 43% by weight of solids of tetrasodium phosphate, 3 to 11% by weight of solids of primary zinc orthophosphate, 1 to 10% by weight of solids of primary manganese orthophosphate, 5 to 15% by weight of solids of disodium dihydrogen diphosphate and 15 to 25% by weight of solids of potassium polyphosphate.

15. Lubricant according to claim 11 wherein the phosphate mixture additionally contains an additive selected from boric acid, hydroxy apatite and mixtures thereof.

16. Lubricant according to claim 15 wherein the phosphate mixture additionally contains an additive selected from 5 to 25% by weight of solids of boric acid, 0.5 to 15% by weight of solids of hydroxy apatite and mixtures thereof.

17. Lubricant according to claim 1 in the form of an aqueous dispersion with a solids content of 20 to 40% by weight of dispersion wherein percentages of solid components are by weight of total solids.

18. Lubricant according to claim 1 wherein it additionally contains at least one additional solid lubricant in a quantity of 1 to 5% by weight of solids.

19. Lubricant additive comprising a phosphate mixture including 25 to 50% by weight of solids of tetrasodium diphosphate, 1 to 20% by weight of solids of primary zinc orthophosphate, 0.5 to 20% by weight of solids of primary manganese orthophosphate, 2 to 25% by weight of solids of disodium dihydrogen diphosphate and 8 to 35% by weight of solids of potassium polyphosphate.

20. Lubricant additive according to claim 19 comprising 33 to 43% by weight of solids of tetrasodium diphosphate, 3 to 11% by weight of solids of primary zinc orthophosphate, 1 to 10% by weight of soilds of primary manganese orthophosphate, 5 to 15% by weight of solids of disodium dihydrogen diphosphate and 15 to 25% by weight of solids of potassium polyphosphate.

21. Lubricant additive according to claim 19 additionally comprising an additive selected from the group consisting of 5 to 25% by weight of solids of boric acid, 0.5 to 15% by weight of solids of hydroxy apatite and mixtures thereof.

22. A method for lubricating a mandrel comprising using the lubricant of claim 1.

23. A method for lubricating a mandrel comprising applying the lubricant of claim 3 to a mandrel.

24. A method for lubricating a mandrel comprising applying the lubricant of claim 17 to a mandrel.

25. A method for lubricating a mandrel comprising applying the lubricant of claim 19 to a mandrel.

* * * * *